US005575867A

United States Patent [19]

Renner

[11] Patent Number: 5,575,867

[45] Date of Patent: Nov. 19, 1996

[54] METHOD OF PREVENTING LOCAL CORROSION AT WELD JOINTS

[75] Inventor: Michael Renner, Leichlingen, Germany

[73] Assignee: Bayer Aktiengesellschaft, Leverkusen, Germany

[21] Appl. No.: 516,225

[22] Filed: Aug. 17, 1995

[30] Foreign Application Priority Data

Aug. 24, 1994 [DE] Germany ..... 44 29 975.3

[51] Int. Cl.[6] ..... C21D 6/00

[52] U.S. Cl. ..... 148/606; 148/605; 148/529

[58] Field of Search ..... 148/605, 633, 148/529, 606

[56] References Cited

FOREIGN PATENT DOCUMENTS 55-97429 7/1980 Japan ..... 148/600

57-89422 6/1982 Japan ..... 148/633

OTHER PUBLICATIONS

J. R. Cahoon, et al., Corrosion, vol. 38, No. 6, pp. 299–305, (1982).

S . Turner, et al., vol. 45, No. 9, pp. 710–716, (1989).

A. S. M. Diab, et al., Werkstoffe und Korrosion, vol. 44, pp. 367–372, (1993).

*Primary Examiner*—Deborah Yee

*Attorney, Agent, or Firm*—Sprung Horn Kramer & Woods

[57] ABSTRACT

A method of preventing corrosion damage at weld joints, in the heat affected zones of weld joints, and in heat-treated zones of components made of stainless steels having chromium contents ≧12% by weight, which comprises exposing weld joints and the heat affected zones of the weld joints, or the heat-treated zones, to a water vapor atmosphere at temperatures of 100° to 250° C. for five to sixty minutes.

6 Claims, No Drawings

METHOD OF PREVENTING LOCAL CORROSION AT WELD JOINTS

This invention relates to a method of treating weld joints in order to prevent local corrosion at these locations in use.

Thermally formed metal oxides, such as those which are formed in the presence of oxygen or at low $O_2$ partial pressures during the welding of or due to heat treatment operations performed on steels which are capable of being passivated, for example, have a detrimental effect on the corrosion behavior of stainless steels, particularly on their resistance to attack by local corrosion (pitting corrosion, crevice corrosion), irrespective of their lattice structure and their microstructural state [Cahooh, J. R., Bandy, R., Corrosion 36 (1982), 299; Turner, S., Robinson, F. P. A., "The Effect of the Surface Oxides Produced during Welding on the Corrosion Resistance of Stainless Steels", Corrosion September 1989; Diab, A. S. M., Schwenk, W., "Beintr ächtigung der Lochkorrosionsbeständigkeit von NiCr St ählen durch dünne Oxidschichten" [Impairment of the resistance of CrNi steels to pitting corrosion by thin oxide layers], Werkstoffe und Korrosion [Materials and Corrosion] 44, 367–372 (1993)]. Attempts have therefore been made to provide a remedy in this area. For example, welded locations (weld joints, weld seams) or heat-treated locations have been processed mechanically (brushing, grinding, sand-blasting) or have been pickled using acidic media of various compositions. Pickling is preferably employed due to its ease of operation and its good effect, since mechanical treatment results in only a slight improvement in corrosion resistance. Pickling has a series of disadvantages, however. This method is very costly, particularly for pipeline systems of considerable length, and moreover the used pickling solution, which is contaminated with metal ions, has to be disposed of. In addition, the use of acids as the pickling solution necessitates considerable safety measures.

The object of the present invention is therefore to provide a method which enables weld joints on steels which are capable of being passivated to be treated efficiently and economically, so that such weld joints or heat affected zones are thereafter more resistance to corrosion.

This object can be achieved by means of the method according to the invention.

The present invention relates to a method of preventing corrosion damage at weld joints, in the heat affected zones of weld joints, and in heat-treated zones in components made of stainless steels having chromium contents ≧12% by weight, which is characterized in that after welding or heat treatment the weld joints and the heat affected zones of the weld joints, or the heat-treated zones, are exposed to a water vapor atmosphere at temperatures of 100° to 250° C. for five to sixty minutes, preferably from 15 to 45 minutes.

The welded or heat-treated components which are treated by the method according to the invention are preferably used where they come into contact with water of various origins and areas of use, such as cooling water, in cooling circuits, in fire extinguisher lines, filtrates from waterside embankments, for example. In general, the welded or heat-treated components made of stainless steels which are treated by the method according to the invention are used in chemical, power station and environmental engineering applications.

The invention is described in more detail in the following illustrative examples.

EXAMPLES

Example 1

A pipeline with a length of about 1.70 m, made of Type X 6 CrNiMoTi 17 12 2 stainless steel (material number 1.4571, comparable with AISI 316; chemical composition: 16.9 weight % Cr, 11.2 weight % Ni, 2.08 weight % Mo, 0.35 weight % Ti, 0.29 weight % Co, <0.01 weight % N, 0.001 weight % S, 0.03 weight % P, 0.35 weight % Si, <0.04 weight % C, 1.5 weight % Mn, balance Fe) was manufactured with a plurality of weld seams of different initial colors (corresponding to the various oxides formed during welding). One of the weld seams was pickled before the pipe was used (pickling solution: 20% $HNO_3$/3% HF/77% $H_2O$). Filtrate from a river bank (which also contained biomass from the gravel bed filter at the water take-off point of the river) was pumped through the pipe at 40° C. for several weeks. With the exception of the weld seams which were initially a straw yellow color, and of the pickled weld seam, pitting corrosion and holes in the pipe wall were evident after only six weeks at the other weld seams and in the heat affected zones of the weld seams.

Example 2

A pipeline was manufactured as in Example 1, but with the difference that the weld seams were subsequently treated with steam at a pressure of 5 bar for half an hour. The pipeline was then exposed to a river bank filtrate as in Example 1 at temperatures up to 55° C. After more than a year, no corrosion was observed at the weld seams and in the heat affected zones of the weld seams.

It will be understood that the specification and examples are illustrative but not limitative of the present invention and that other embodiments within the spirit and scope of the invention will suggest themselves to those skilled in the art.

I claim:

1. A method of preventing corrosion damage at weld joints, in the heat affected zones of weld joints, and in heat-treated zones of components made of stainless steels having chromium contents ≧12% by weight, which comprises exposing the weld joints and the heat affected zones of the weld joints, or the heat-treated zones, to a water vapor atmosphere at temperatures of 100° to 250° C. for five to sixty minutes.

2. The method according to claim 1, wherein the exposure to the water vapor atmosphere is for 15 to 45 minutes.

3. In the formation of a corrosion-resistant weld joint wherein two sections of weldable stainless steel each having a chromium content of ≧12% by weight are hot welded, and the weld joint is thereafter treated to reduce subsequent corrosion damage, the improvement wherein such treatment is effected by exposing the weld joint and zones affected by the heat of the welding to a water vapor atmosphere at a temperature from about 100° to 250° C. for about 5 to 60 minutes.

4. The method according to claim 3, wherein the exposure to the water vapor atmosphere is for from about 15 to 45 minutes.

5. In the formation of a corrosion-resistant heat-treated zone in stainless steel having a chromium content of ≧12% by weight wherein a zone of said metal is heat-treated, and thereafter treated to reduce subsequent corrosion damage, the improvement wherein said after-treatment is effected by exposing the heat-treated zone to a water vapor atmosphere at a temperature from about 100° to 250° C. for about 5 to 60 minutes.

6. The method according to claim 5, wherein the exposure to the water vapor atmosphere is for from about 15 to 45 minutes.

* * * * *